US005296042A

United States Patent [19]

Curran et al.

[11] Patent Number: 5,296,042

[45] Date of Patent: Mar. 22, 1994

[54] COMPOSITION AND PROCESS FOR TREATING SHEET STEEL

[75] Inventors: Michael S. Curran, DeKalb; Kenneth R. Kaluzny, Joliet; William R. Moe, McHenry, all of Ill.

[73] Assignee: C. L. R. Resources, Inc., Genoa, Ill.

[21] Appl. No.: 972,647

[22] Filed: Nov. 6, 1992

[51] Int. Cl.[5] ..... C23G 1/08

[52] U.S. Cl. ..... 134/41; 134/2; 134/3

[58] Field of Search ..... 134/2, 3, 41

[56] References Cited

U.S. PATENT DOCUMENTS

| | | | |
|---|---|---|---|
| 2,396,938 | 1/1944 | Bersworth | 134/2 |
| 3,072,502 | 1/1963 | Alfano | 134/3 |
| 3,460,989 | 8/1969 | Rusch | 134/3 |
| 3,506,576 | 4/1970 | Teumac | 252/82 |
| 3,864,139 | 2/1975 | Heller | 106/287 R |
| 3,973,998 | 8/1976 | Datta et al. | 148/6.14 R |
| 3,996,092 | 12/1976 | Frost et al. | 134/2 |
| 4,000,012 | 12/1976 | Burrows et al. | 148/6.15 R |
| 4,448,847 | 5/1984 | Bell et al. | 428/413 |
| 4,578,208 | 3/1986 | Geke et al. | 134/2 |
| 4,666,528 | 5/1987 | Arrington et al. | 134/2 |
| 5,015,298 | 5/1991 | Arrington | 134/2 |

FOREIGN PATENT DOCUMENTS 1211406 9/1986 Canada .

*Primary Examiner*—R. Bruce Breneman
*Assistant Examiner*—Thomas G. Dunn, Jr.
*Attorney, Agent, or Firm*—Mathew R. P. Perrone, Jr.

[57] ABSTRACT

Stain on sheet steel is removed by providing a solution of buffered chelating agent and applying the same to the sheet steel during processing and prior to coiling.

11 Claims, 5 Drawing Sheets

FIG. 4
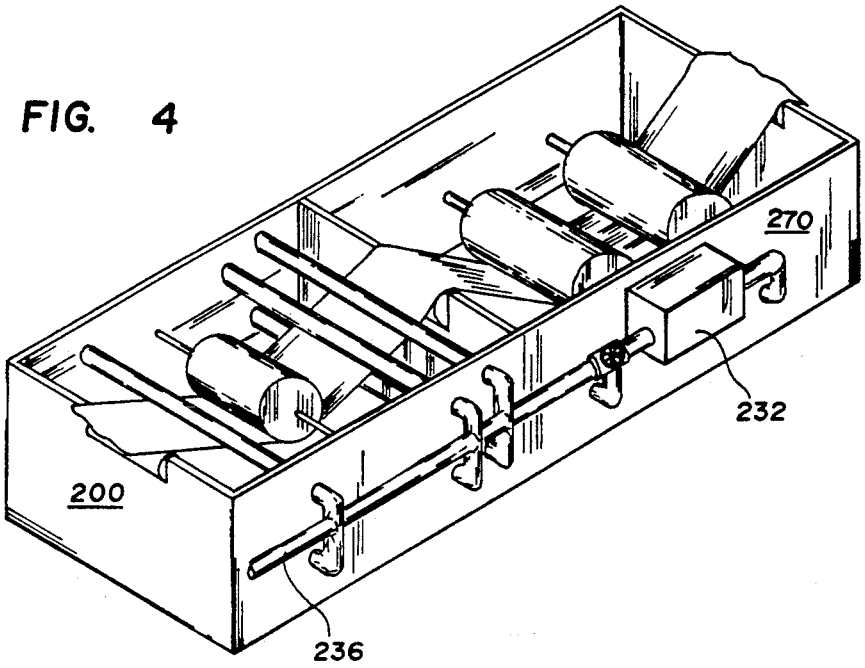
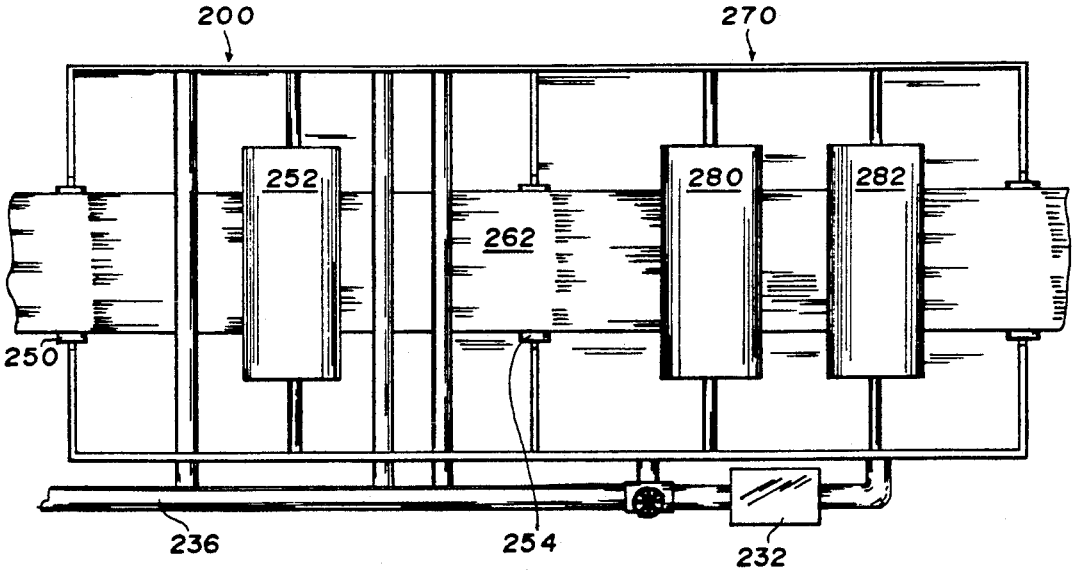
FIG. 5

COMPOSITION AND PROCESS FOR TREATING SHEET STEEL

This invention relates to a composition for and process of treating sheet steel, and more particularly to a composition for and process of treating sheet steel with a buffered chelating agent.

BACKGROUND OF THE INVENTION

A special steel widely used in many of the industries is sheet steel. Sheet steel is used in automobiles, appliances, and similar goods. It is manufactured in primary mills. Also scrap steel from vehicles, refrigerators and other sources is used in secondary mills with additional iron ore and coke to form more steel, including sheet steel.

It is a problem, especially in the primary mills, to produce a sheet steel free and clear of corrosion and stain. Customers are more and more demanding in that they desire efficiently produced, and clean sheet steel. This combination of requirements is extremely difficult to obtain. In the processing of sheet steel, any delay or slow down results in stain or other undesirable material being formed on the sheet steel.

It is an uneconomical and an inefficient use of resources to simply discard this steel or to forward it for reprocessing as has been done in the past. It is very desirable to process the steel and avoid the stain in the first place. Such a procedure for treating sheet steel is extremely difficult to carry out. Yet, in this process, difficulty is caused by the high speed processing and the reduced time for achieving these desired results. It is very desirable to develop a process for removing the stain from sheet steel during the course of manufacturing in a simplified efficient fashion.

Such a simplified, efficient process of removing stain from sheet steel is difficult to obtain. While many compositions are known to remove the stain from steel in other forms, it is extremely difficult to apply the compositions and remove the stain from sheet steel at high speed.

By achieving such removal at high speed, inefficiencies can result. Where such stain removal is achieved by the process of the prior art, it is done at a slower pace or with environmentally hazardous materials. It is very desirable to achieve this stain removal quickly, yet in an environmentally efficient fashion and avoid such stain reforming on the sheet steel. It is further desirable that the waste therefrom be environmentally neutral and easily disposable. Accordingly, if the development of a process or composition to accomplish these goals is achieved, great advantages are obtained both for environmental needs and other societal needs.

Hot rolled sheet steel processed on high speed coil lines (FIG. 1), when pickled with hydrochloric acid suffers from iron and chloride staining. Hot rolled sheet steel must be pickled to remove the scale that is formed during the hot rolling process. The scale is an oxide that is predominantly ferric oxide. However, the stains occur after the pickling tanks used in this sheet steel process, and in the subsequent rinse sections during line stops where residual iron and chloride ions react with and precipitate onto the sheet steel.

The composition of the stain varies with its proximity to the pickle tanks. Predominantly the stain comprises of ferrous and ferric hydroxides. There are also ferrous and ferric chlorides present. The percentage of ferrous and ferric chlorides present in the stain gradually increases as the stain nears the pickle section. While in the past, primary producers of sheet steel did not find these stains detrimental, these stains are now a major problem.

An increasing percentage of the hot rolled sheet steel is designated for commercial use. The commercial hot rolled sheet steel, which is stained, is usually sent to a service pickling company. This service company buys and pickles the hot rolled sheet steel before it is sold to the end users.

The service pickler buys the stained coils at a discounted price. Then, in turn, that service pickler sells the repickled coils at commercial prices. The service pickler does not experience the "staining" problem to the extent of the primary producer, because the service pickler runs the line at substantially lower line speeds.

The pricing differential between the primary producer's discounted price and the service pickler's commercial price causes the impetus for the primary producer to compete in this market. The widening price differential is greatly due to increases in costs of transporting and reprocessing of the stained coils. The primary producers need to find another way to produce this portion of the commerical grade hot rolled sheet steel within their own production facilities. Current technology does not allow for maximum capacity to produce a commercial grade hot rolled sheet steel. Producers must slow the high speed coil lines down from about 400 meters per minute to about 60 meters per minute to prevent the line stops, which create staining.

The line stops occur due to welding and cutting operations. The high speed coil lines are continuous coil lines. At the beginning of the process, the sheet steel coils are welded to the previous coil. At the end of the process, the steel coils are cut from the continuous steel strip. The high speed coil lines have sections to take up coil so that during welding and cutting operations there is enough sheet steel in the system to keep the strip moving through the pickling and rinse sections and to prevent stops. However at speeds of about 400 meters per minute there is not enough accumulated coil to prevent a line stop.

The user of proprietary chemicals attempts to minimize staining of the sheet steel. Chelating chemicals can form soluble complexes with iron ions in the rinse water, thus preventing the formation of iron precipitates. When the rinse water dilutes the residual acid film after pickling and its pH rises to about pH 6.0, hydrated iron oxides precipitate on the ferrous surface of the sheet steel. Wetting agents can aid in the removal of acid residues and minimize hydrochloric acid pickle carry over due to the wetting agents effect to produce thinner surface films on the sheet steel. The thinner films will contain less iron and chloride ions, which in turn reduces the extent of the stain formed during line stops.

The efficiency of the stain removing chemicals are directly related to rinsing techniques. Residual chloride ions contribute to the formation of the stain. The chloride ions are present due to the hydrochloric acid carry over. Rinsing is of major importance in order to remove these residual chloride ions. The rinsability of chloride ions are achieved by the method of rinsing (spray, immersion, or a combination of both), spray pressure and flow, and spray pattern Also, the use of squeegee rolls and their placement are critical for better rinsing. All of these rinsing techniques for high speed coil lines effect chloride removal. However, none of these techniques are completely effective at removing all of the chloride ions that help to create the stain.

Formulations designed to prevent iron and chloride staining are not effective due to pickle line configurations. This is especially true in areas of the pickle line before and after the squeegees, and the inaccessible areas of the sheet steel, which cannot be rinsed because of their proximity to the pickle tanks.

Known in the art is a method of removing iron- and copper- containing scale from the interior metal surface of a boiler utilizing an admixture of polycarboxylic acids and phosphonic acids and their salts thereof. Scale is also removed from steam boilers, petrochemical process equipment, feedwater heaters and associated piping, and in various types of pressure vessels, such as high pressure steam generating equipment utilized in electric power generation and other applications, in which water is circulated and heat transfer occurs. These metallic surfaces are internal parts of process equipment. Such treatments are used to restore the efficiency of the process equipment by removing the scale, as a maintenance procedure.

The characteristics of stain and scale also differ with regard to composition and creation Stain is the steel industry's jargon for hydrated ferrous and ferric oxides, and ferrous and ferric chlorides. The scale may also include cuprous and cupric oxides, and water-soluble salts such as calcium carbonate, calcium hydroxide.

The stain is produced on sheet steel in a relatively short time (less than 15 minutes) when the hydrochloric acid pickle line stops. During line stops the stain is formed from residual ferrous and ferric chlorides that remain on the sheet steel surface after hydrochloric acid pickling. When the rinse water dilutes the residual acid film left on the surface, and its pH rises to about pH 6.0, hydrated iron oxides can form and can be left on the surface as an insoluble precipitate. This flash rusting or staining may occur especially in the first rinse stage at low line speeds, or if the sheet steel dries out during line stops.

The formation of scale is only similar to the formation of stain in so much that both are formed due to the phenomenon of insolubility, such as is described in U.S. Pat. No. 4,666,528, incorporated herein by reference. The primary reason for scale formation is the fact that the solubilities of the scale-forming salts decrease with increases in temperature and concentrations. When feedwater is elevated to boiler water temperature and concentrations, the solubility of the scale forming salts is exceeded. Scale forms by one or a combination of the following mechanisms.

1) The improper precipitation of relatively insoluble feedwater hardness compounds (for example, calcium carbonate precipitating at the metal surface by the following possible mechanism):

$$2\ Ca(HCO_3)_2 + \text{Heat, yields,}$$

$$2\ CaCO_3 + 2\ H_2O + 2\ CO_2.$$

2) The supersaturation, or crystallization, of relatively soluble dissolved solids ($CaSO_4$,$SiO_2$) in water contacting heat transfer surfaces. This undesired coating on the sheet steel is usually a mixture of calcium sulfate and silicon dioxide ($CaSO_4$,$SiO_2$).

3) The accumulation of corrosion products (iron and copper oxides) or other suspended matter in the feedwater with subsequent deposition on the high heat transfer metal surfaces.

This complex or group of complexes is very stable. Such stability makes it hard to dissolve or otherwise remove the complexes as desired.

SUMMARY OF THE INVENTION

Accordingly among the many objectives of the present invention is to provide an improved composition for and process of removing stain or scale from sheet steel with a substantially, environmentally acceptable composition.

It is a further objective of this invention to provide an improved process of removing stain from sheet steel quickly.

A still further objective of this invention is to reduce customer rejection of sheet steel.

Yet a further objective of this invention is to provide a process of improving efficiency at a primary mill.

Also an objective of this invention is to provide a process of removing iron and chloride containing stains from the hot rolled sheet steel.

Another objective of this invention is to provide a process of avoiding a rinse stain on sheet steel.

Yet another objective of this invention is to avoid extra transportation in sheet steel manufacturing.

Still another objective of this invention is to provide a process for reducing stains in the manufacture of sheet steel.

It is a further objective of this invention to provide an improved process of maintaining the solubility of the iron ion to prevent redeposition of the stain.

A still further objective of this invention is to remove the stain without interfering with the overall quality of the ferrous substrate.

Yet a further objective of this invention to provide an improved composition for removing stain from sheet steel quickly.

These and other objectives of the invention (which other objectives become completely clear by considering the specifications, claims and drawings as a whole) are met by providing a solution of buffered chelating agent and applying the same to the sheet steel during processing and prior to coiling.

BRIEF DESCRIPTION OF DRAWINGS

FIG. 4 depicts a perspective view of destaining apparatus 190 of this invention, using a spray tank 200 and a dip tank 270 in combination.

FIG. 5 depicts a top, plan view of destaining apparatus 190 of this invention, using a spray tank 200 and a dip tank 270 in combination.

Throughout the figures of the drawings, where the same part appears in more than one figure, the same number is applied thereto.

DESCRIPTION OF THE PREFERRED EMBODIMENTS

Iron and chloride containing stains are removed from the hot rolled sheet steel. By treating the sheet steel with a buffered chelating agent to remove the stain, once removed, the chelating agent maintains the solubility of the iron ion to prevent redeposition of the stain on the sheet steel. This method and composition removes the stain (destaining) without interfering with the overall quality of the ferrous substrate or sheet steel.

The waste from this method is generally considered environmentally neutral. In the areas that regulate phosphorous for environmental reasons, a known method of treatment can be applied to remove the phosphorous used in the treatment of this invention from the rinse water in a simple fashion.

Polyphosphonic acid, or the alkali metal or amine salt or the ammonium salt of this acid is used to remove copper and iron-containing scale from a ferrous metal surface, especially sheet steel, provided a long contact time is used. Also, a method of removing iron and copper containing scale from a metal surface by contacting the scale with a composition of an admixture of an aminopolycarboxylic acid, such as ethylenediaminetetraacetic acid (EDTA), or the alkali metal salts or ammonium salts or amine salts of the polycarboxylic acid and a polyphosphonic acid such as aminotrimethylenephosphonic acid (ATMP),or an alkali metal salt or amine salt or ammonium salt of the phosphonic acid is now usable, provided, a long contact time is used.

It is the custom of the intended industry, steel producers, to refer to the ferrous and ferric chlorides and the hydrated ferrous and ferric oxides as a "stain." This invention describes a method of and composition for removing iron oxide and chloride stain from a ferrous metal surface by contacting the stain with a composition of one or more components selected from the group consisting of a phosphonic acid or salt thereof, a polyphosphonic acid or salt thereof, and a polycarboxylic acid or salt thereof.

The key factor in removing the undesired stains and simplifying the manufacture of substantially stain-free sheet steel is clearly the buffered chelating agent of this invention. This method of treatment with a composition of this invention improves the appearance of the sheet steel and avoids the problems inherent in sheet steel having stains thereon.

An acid used herein to remove such stains is a phosphonic acid such as 1-hydroxyethylidene-1,1-diphosphonic acid (HEDP). Salts thereof, which are suitable, include an alkali metal salt, an amine salt, an ammonium salt or combinations thereof. Also useful is a polycarboxylic acid such as nitrilotriacetic acid (NTA). Salts thereof, which are suitable, include an alkali metal salt, an amine salt, an ammonium salt or combinations thereof.

Figure 1A:
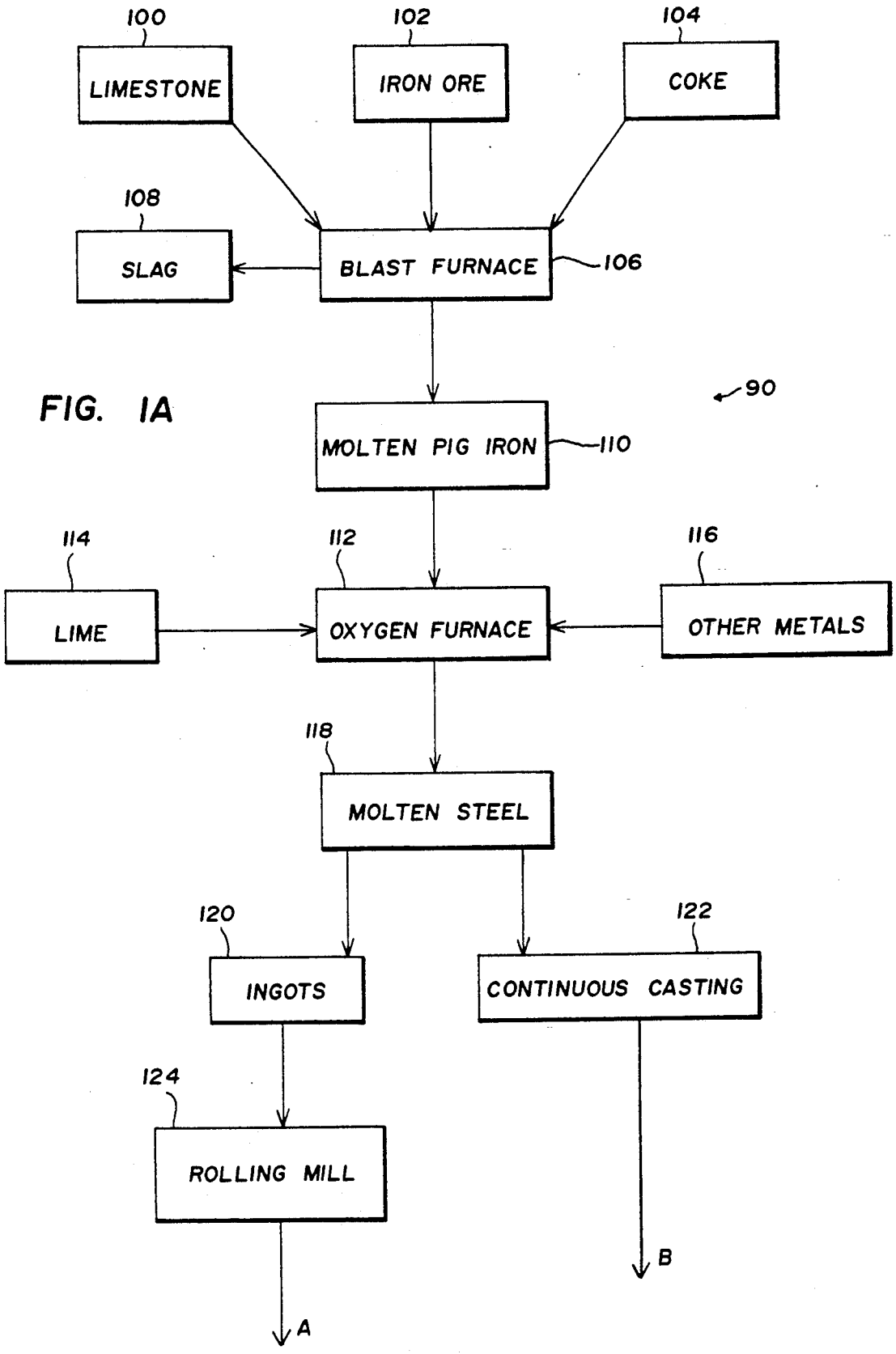
FIGS. 1A, 1B, and 1C combine to depict a block diagram of sheet steel forming apparatus 100 usable with a destaining apparatus 120 of this invention.
Figure 1B:
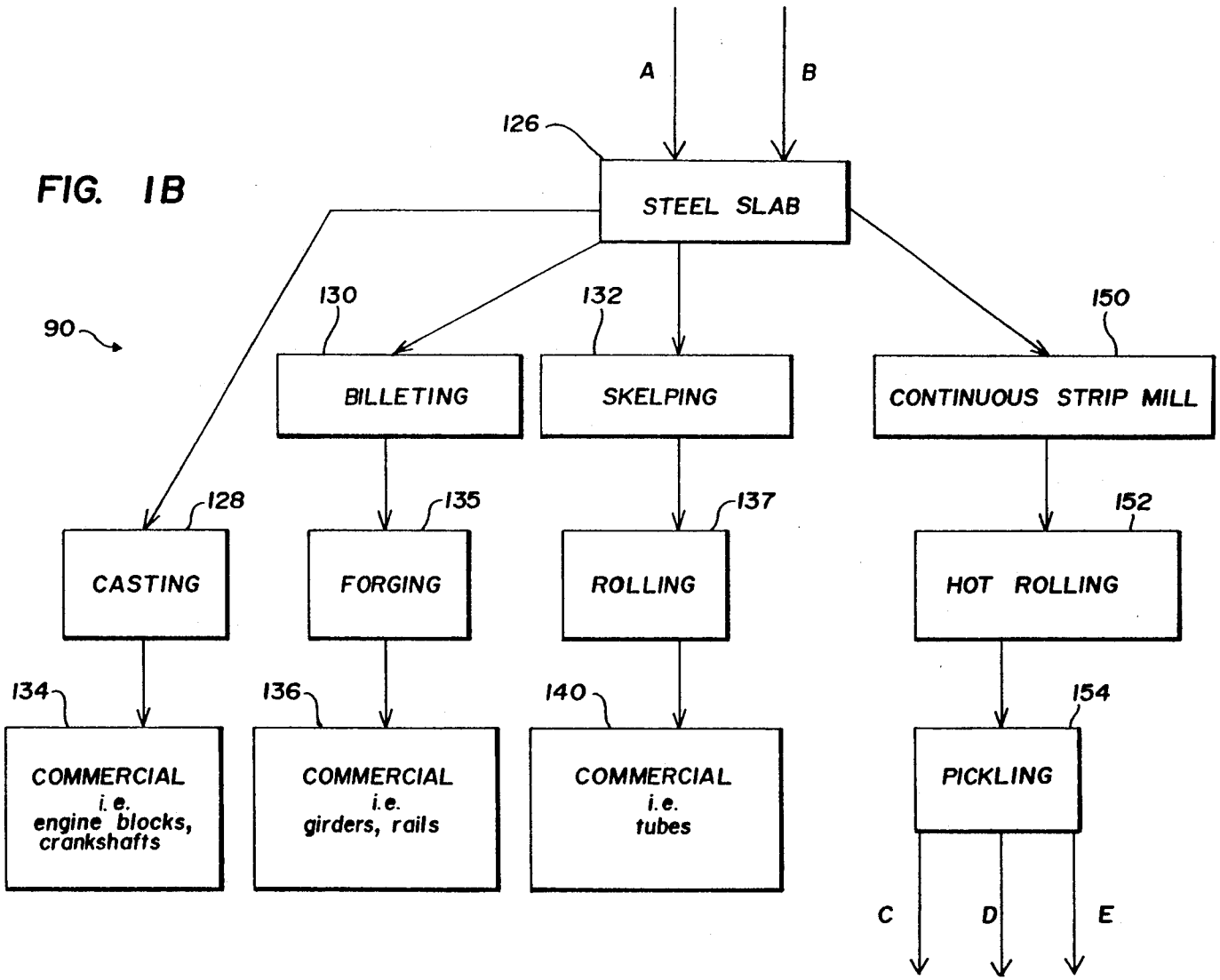
Figure 1C:
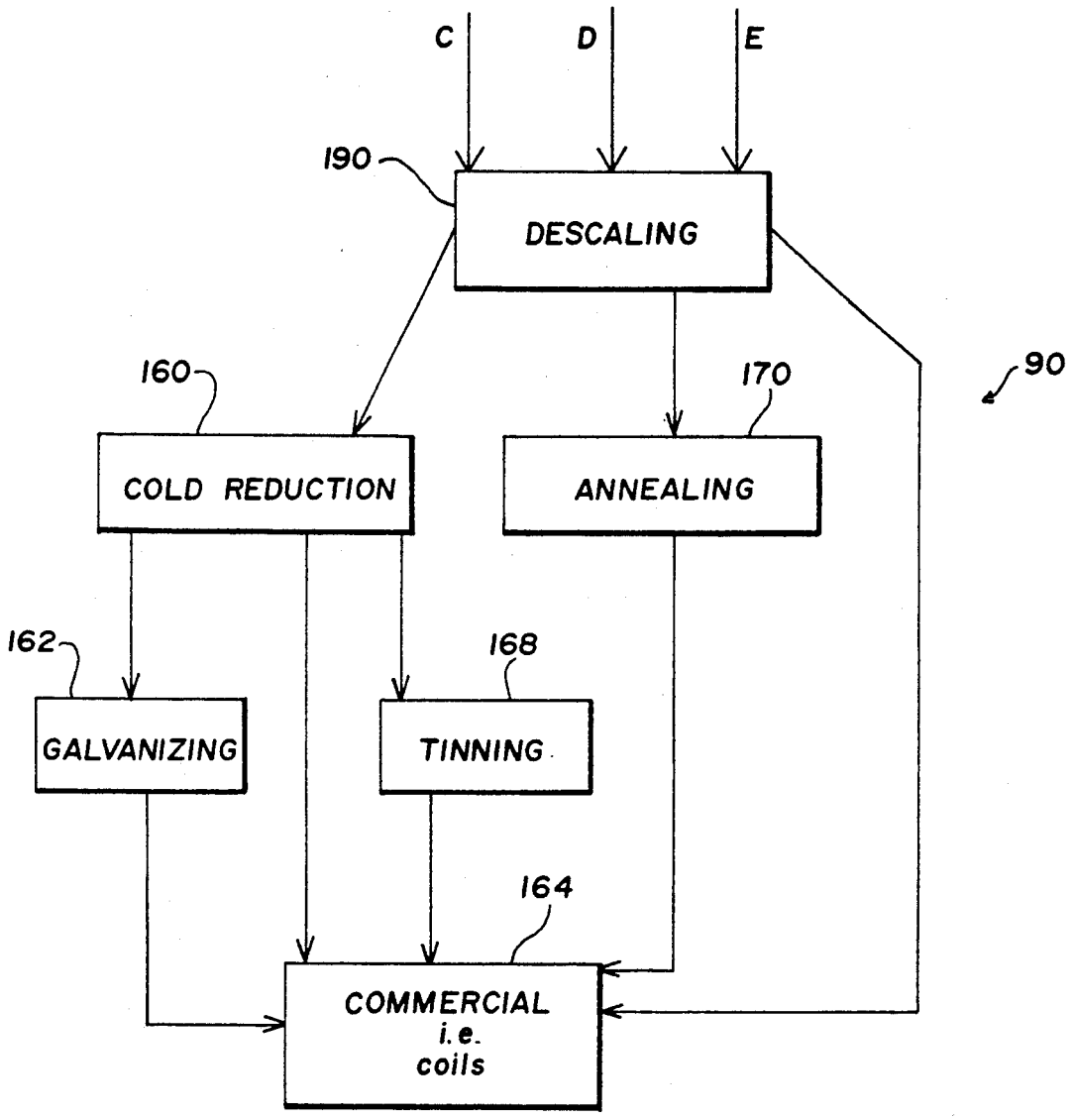

Referring now to FIG. 1, a standard steel-making apparatus 90 is shown in block diagram form. Limestone 100, iron ore 102, and coke 104 is deposited in blast furnace 106. Slag 108 is taken out of blast furnace 106 and discarded. Molten pig iron 110 is taken from the blast furnace 106 and placed in the oxygen furnace 112.

Also added to the oxygen furnace is lime 114 and other metals 116. In this fashion, molten steel 118 is formed. The molten steel can be divided into two classes, ingots 120 and continuous casting 122. The ingots 120 proceed on to the rolling mill 124 then to the steel slab 126. The steel slab 126 is split into casting 128, billitting 130, and skelping 132. Casting 128 goes into commercial uses such as engine blocks and crankshafts 134. Forging goes into commercial girders and rails 136. Skelping goes to rolling then to commercial tubes 140. Continuous casting 122 can also lead to steel slab 126.

This steel slab 126, as one option, is taken to a continuous strip mill 150 where the slab 126 is treated to hot rolling 152 to form a sheet 262 (shown in FIG. 2) and then pickling 154. After pickling, the sheet 262 may undergo cold reduction 160 and then galvanizing 162 and followed by forming coils in commercial 164. The cold reduced sheet steel 262 may also go directly to commercial 164. The cold reduced sheet steel 262 may also undergo tinning 168.

After pickling 154, sheet steel 262 may also undergo annealing 170 and go to commercials 164. It is after the pickling 154, that the treatment destaining apparatus 190 of this invention is required to remove the stains off the sheet steel 262.

The destaining apparatus 190 is plugged into FIG. 1 and the steel making apparatus 100, after the pickling step 154. The sheet steel 262 may be cleaned or otherwise relieved of scale or stain. The destaining apparatus 190 may use a spray tank 200, an immersion tank 270, or both a spray tank 200 and an immersion tank 270 together in any order.

Figure 2:
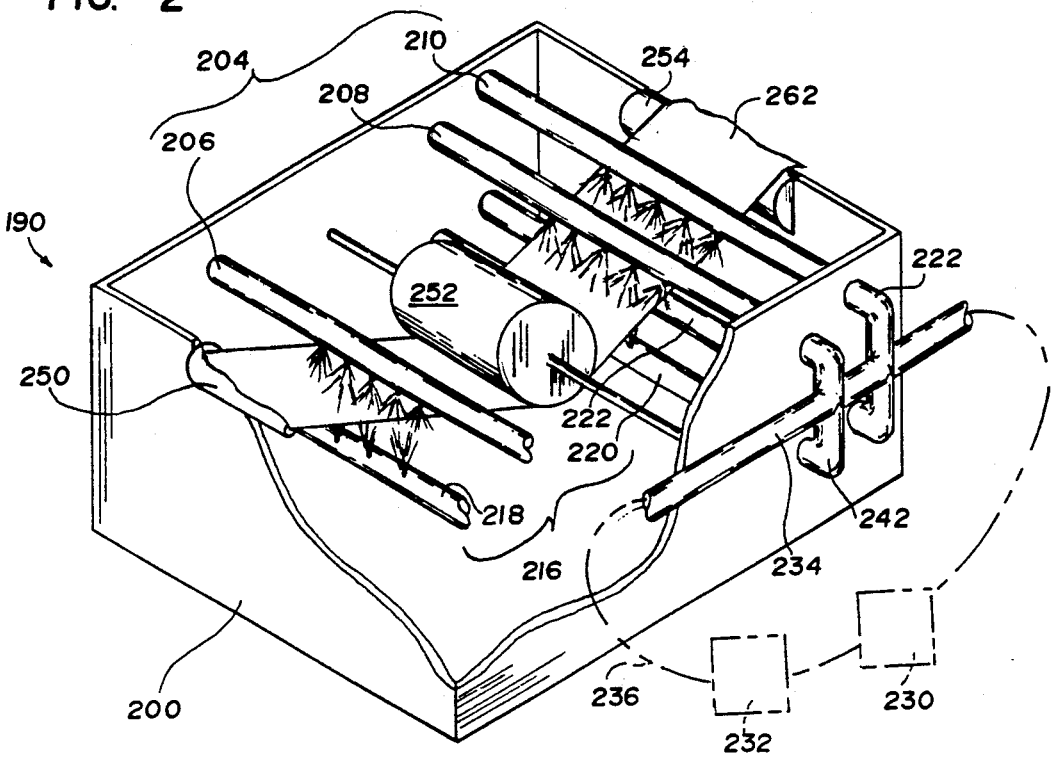
FIG. 2 depicts a perspective view of destaining apparatus 190 of this invention, using a spray tank 200.

In FIG. 2, a spray tank 200 includes a set of upper nozzles 204 and a set of lower nozzles 216. The upper nozzles 204 include a first upper nozzle 206 a second upper nozzle 208 and a third upper nozzle 210. The upper nozzles 204 are mounted by appropriate pipes over the sheet steel 262. Below the sheet steel 262 and within the spray tank 200 are the lower nozzles 216. There is a first lower nozzle 218, a second lower nozzle 220 and a third lower nozzle 222.

The nozzles are fed from a supply tank 230 by the pump 232 through the connecting pipe 234. The supply pipe 236 feeds from the supply tank 230 into the pump 238. The feed pipe 242 handles the feed of the destaining composition from connecting pipe 234 to the nozzles.

The feed of the upper nozzles 204 is handled by the upper pipes 222. In this fashion, the sheet steel 262 can be sprayed from upper nozzles 204 and lower nozzles 216. The spray tank 200 catches the sprayed material and recirculates to the supply tank 230.

The feed of the lower nozzles 216 is handled by the lower pipes 242. In this fashion, the sheet steel 262 can be sprayed from upper nozzles 204 and lower nozzles 216. The spray tank 200 catches the sprayed material and recirculates to the supply tank 230.

The spray tank 200 is fed by an entrance roller 250 over which the sheet steel 262 passes. A feed roller 252 is centrally located in the spray tank 200 and receives the sheet steel 262 so that the sheet steel 262 may be fully exposed to all nozzles. An exit roller 254 feeds the sheet steel 262 to the next tank or treatment process.

Figure 3:
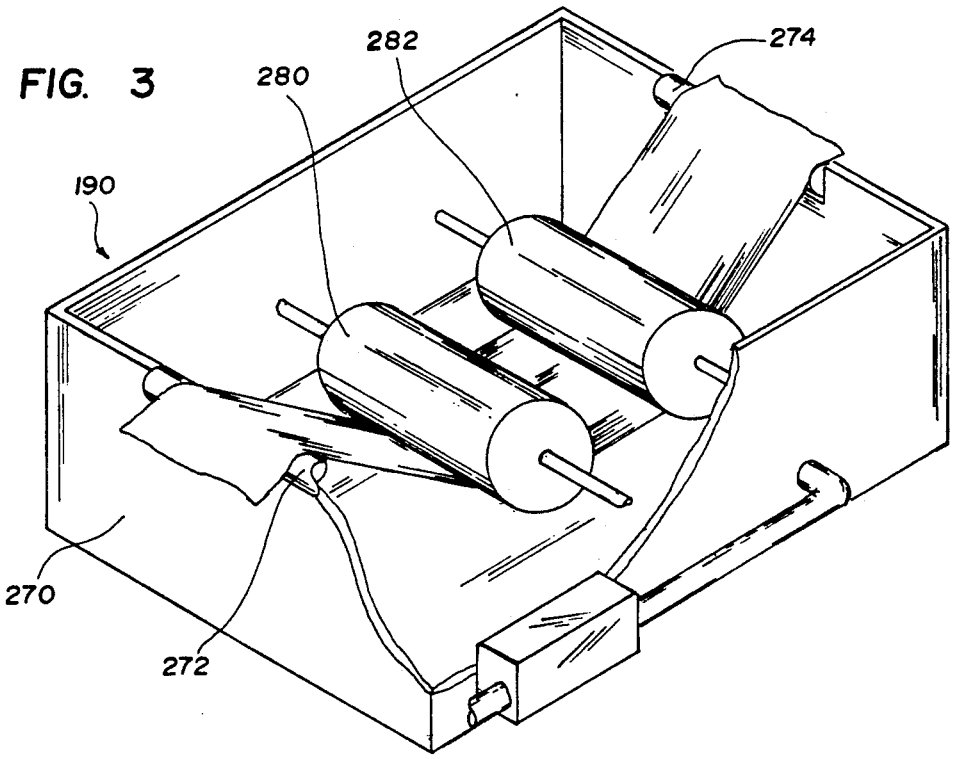
FIG. 3 depicts a perspective view of destaining apparatus 190 of this invention, using a dip tank 270.

Referring now to FIG. 3, the immersion tank 270 has an immersion feed roller 272 an exit feed roller 274. Situated therebetween is a first coil support roller 280 and a second coil support roller 282 in order to force the sheet steel 262 into the immersion tank 270 to be completely submerged into the desired stain or scale removing agent. The immersion tank 270 is of course deep enough so that the sheet steel 262 is successfully immersed therein to achieve the desired stain removing or scale removing.

In FIG. 4 and FIG. 5, the combination of the spray tank 200 and immersion tank 270 is shown. The tanks are combined whereby the immersion tank feed roller 272 serves a dual function of being the exit roller 254 for the spray tank 200. In this fashion, the sheet steel 262 can receive both treatments. This structure is especially suitable for treating the heavy duty stains on sheet steel 262.

In this fashion, the cleaning material is used efficiently and effectively. Both the spray tank 200 and the immersion tank 270 can be of any suitable size as desired. Generally speaking, it is preferred that the spray tank 200 have a capacity of about 500 cubic meters. It is preferred that the immersion tank 270 have a capacity of about 1000 cubic meters.

The current invention discloses a method of removing iron oxides and iron chlorides from a ferrous metal surface. The ferrous metal surface is sheet steel 262 that has been pickled, fresh water rinsed with the water alone, fresh water rinsed with an aqueous solution of an admixture of phosphonic acids and polycarboxylic acids and their salts thereof, dried, oiled and recoiled. The metal surface in this instance is a product of the steel making process. This invention is a product of the steel making process. This invention provides a treatment for the sheet steel 262 that subsequently produces sheet steel 262 with better quality, more quickly, and more efficiently, therefore in a more profitable manner.

This invention is used to remove the stain with an aqueous stain removing composition having a pH from about 4.0 to about 10.5 contacting the stain at temperatures of about 75° C. to about 105° C. Complete stain removal occurs with these parameters in about 5 seconds to maximum of 2 minutes. The time to remove scale and stain is the fundamental difference in the operating processes.

Basically, it is desired that the pickling solution be in the 6 to 9 pH range. It is generally a buffered phosphonate. With the buffered phosphonate and treatment of the steel for 25 to 45 seconds at 80° C. to 95° C. at a desired concentration of up to 10 grams per liter of chelating agent, tremendous results are obtained in removing the steel and making the sheet steel 262 stain-free. An especially preferred phosphonate is one 1-hydroxyethylidene-1,1-diphosphonic acid. Salts of that acid include the potassium salt, the sodium salt, the ammonium salt, the triethenolamine salt, the diethanolamine salt and the monoethanolamine salt. In this fashion, the appropriate chelating agent can be used.

Specifically the other salts desired are an ethylenediaminetetraacetic acid (EDTA) salt, a citrate, a gluconate, or a phosphonate. These compositions are applied to the sheet steel 262 by combination of spray and immersion process, or a separate spray process or a separate immersion process to achieve the desired results.

The buffering agent can be potassium hydroxide, sodium hydroxide, ammonium hydroxide, triethanolamine, monoethanolamine, and diethanolamine. The concentration of the chelating agent can vary from a concentration of 1 gram per liter to 100 grams per liter. More preferably the concentration of chelating agent is 5 grams per liter to 50 grams per liter. Most preferably, concentration of the chelating agent is 10 grams per liter to 25 grams per liter.

Preferably, the pH is adjusted to a range of 6 to 9. More preferably, the pH is adjusted to a range of 6.5 to 8. Most preferably, the pH is adjusted to 6.6 to 7.5.

Preferably, the treatment temperature is in the range of 65° to 110° Centigrade. More preferably, the treatment temperature is in the range of 75° to 105° Centigrade. Most preferably, the treatment temperature is in the range of 75° to 95° Centigrade.

If an immersion procedure is used, the immersion time of the sheet steel is 5 to 90 seconds. More preferably, the immersion time of any stained section of sheet steel is 15 to 80 seconds. Most preferably, the immersion time of the sheet steel is 25 to 70 seconds.

If the buffered chelating agent is applied by a spray, the preferable spray time is 5 seconds to 60 seconds. More preferably, the spray time is 10 seconds to 45 seconds. Most preferably, the spray time is approximately 10 to 30 seconds.

The length of the spray section, or immersion rinse tank sections is a constraint. After a line stop, the coil drive units are programmed to run at a reduced speed for a limited time before returning to normal operating speed. The speed and time limitations are a function of the rinse section's length. That is the duration of reduced line speed is determined by the length of the rinse section.

In the following examples, which are intended to illustrate without unduly limiting the invention, all parts and percentages are by weight unless otherwise specified.

EXAMPLE 1

A pickle line for sheet steel is modified to include a tank containing a liquid being set up. Into the tank is placed a 40,000 liter water solution of a 1-hydroxyethylidene-1,1-diphosphonic acid having a concentration of ten grams per liter. The solution is buffered to a pH of 8.4 with potassium hydroxide. Sheet steel having a stain of ferrous and ferric chlorides and oxides is passed therethrough. The stain is sufficient to otherwise have the sheet diverted. The tank is heated to a temperature of 90° Centigrade. After a line stop, the sheet of steel is passed through the rinse tank at a temporary line speed of 23 meters per minute, before returning to a standard line speed of 320 meters per minute.

The tank is of sufficient size to permit a section of sheet to remain therein 40 seconds. The tank is about 15 meters long, and wide and deep enough to receive the sheet steel. Upon removal of the sheet steel from the tank, the stain no longer exists.

EXAMPLE 2

A series of tests are conducted to demonstrate the iron oxide dissolving capability of this invention. The chemical compositions utilized have a pH of about 8.5 and comprised of a mixture of 1-hydroxyethylidene-1,1-diphosphonic acid (HEDP) as the phosphonic acid and potassium hydroxide as the alkali metal hydroxide, which is used to buffer the compound.

The first part of this example involves a test for determining the effectiveness of 1-hydroxyethylidene-1,1-diphosphonic acid (HEDP) in dissolving iron oxide at a pH of 8.5, comparing HEDP against citric acid, gluconic acid, and ethylenediaminetetraacetate, tetrasodium salt, tetrahydrate (EDTA-$Na_4$).

| | HEDP | Citric acid | Gluconic acid | EDTA—$Na_4$ |
|---|---|---|---|---|
| gram/liter chelant | 30 | 30 | 60 | 60 |
| ppm Fe (5) dissolved 1800 | 1800 | 51 | 52 | 49 |

where

HEDP is 60% active acid;

citric acid is 100% active acid;

gluconic acid is 50% active acid;

EDTA-$Na_4$ is 40% solids; and
ppm means parts per million
ppm Fe determined by atomic emission spectroscopy.

The test itself consisted of bubbling nitrogen gas into a solution containing 7.5 grams per liter $Fe_3O_4$ (5420 ppm Fe) and 5 grams/liter of ammonium bifluoride at 60° C. for 12 hours. The pH of these solutions is adjusted to pH 8.5 using potassium hydroxide, 45% liquid.

The optimum iron oxide dissolving ability of HEDP is at pH 3.5.The dissolving efficiency decreases gradually through pH 8.5 and falls off very steeply at pH 10.5. In contrast the optimum iron oxide dissolving ability for citric acid falls at pH 5.0 and drops off very rapidly at pH 7.0. The iron oxide dissolving capability of gluconic acid at a pH range from 5.0 to 12.5 is very poor when compared to HEDP and citric acid.

HEDP is considerably more effective at pH 8.5 than citric acid, gluconic acid, and EDTA-$Na_4$. The data indicates that increasing the concentration of either citric acid and gluconic acid would not make them comparable to HEDP.

The next table shows the effect of pH on dissolving iron oxide by various chelants. The various chelants for this example are (1) HEDP, (2) Citric Acid, (3) Gluconic Acid, (4) Citric Acid and HEDP mixture, (5) Gluconic Acid and HEDP mixture.

| gram/liter chelant | (1) 30 | (2) 30 | (3) 60 | (4) 15/15 | (5) 15/30 |
|---|---|---|---|---|---|
| | ppm Fe dissolved | | | | |
| at pH 3.5 | 4800 | 2100 | — | — | — |
| at pH 5.0 | 3800 | 4600 | 490 | 3900 | 1800 |
| at pH 7.0 | 2000 | 164 | — | — | — |
| at pH 8.5 | 1800 | 51 | 52 | 1200 | 1500 |
| at pH 10.5 | 36 | 10 | 8 | 15 | 35 |
| at pH 12.5 | 24 | — | 13 | — | 11 |

The test itself is conducted by bubbling nitrogen gas into a solution containing 7.5 grams/liter $Fe_3O_4$, (5420 parts per million Fe) and 5 grams/liter ammonium bifluoride at 60° C. (140° F.) for 12 hours. The pH of the solutions tested are adjusted with potassium hydroxide, 45% liquid, when necessary. The ppm of iron determination is done using atomic emission spectroscopy.

HEDP dissolves iron oxide much faster at pH 3.5 than citric acid. The maximum dissolution rate for HEDP, under conditions examined in this study, is achieved at pH 3.5. The rate of dissolution of iron oxide slows as the pH is increased.

The next table shows the effect of time on dissolving iron oxide by chelants.

| | HEDP | | | Citric Acid | | |
|---|---|---|---|---|---|---|
| gram/liter chelant | 30 | | | 30 | | |
| Dissolving time (hours) | 1 | 2 | 3 | 1 | 2 | 3 |
| ppm Fe Dissolved | 4200 | 4800 | 4700 | 1900 | 2200 | 2900 |

Again, the test is conducted by bubbling nitrogen gas into a solution containing 7.5 grams/liter $Fe_3O_4$ (5240 ppm Fe) and 5 g/l ammonium bifluoride. The test is conducted at 60° C., and the pH values for both the HEDP and citric acid solutions are 3.5 where:

HEDP is 60% active acid;
citric acid is 100% active acid; and
Fe is determined by atomic emission spectroscopy.

In general, iron oxides are dissolved by chelants most effectively at pH values between 3.0 and 7.0. The solubility of the oxides in chelant solutions drops off very rapidly at a pH above 7.0. A blend of HEDP, and trisodium nitrilotriacetate (NTA) is also better than either of the two used alone. However, it is not as effective as the three component blend. The HEDP/NTA/citric acid blend dissolves the iron oxide in a single step within a pH range from 3.0 to 7.0 very effectively. The HEDP alone passivates the base metal (sheet steel) during the iron oxide dissolving step and helps to prevent the base metal's corrosion.

The following table shows the ability to dissolve iron oxide by using chelants in a tap water solution.

| Chelant type | Grams/liter Chelant | percent iron oxide dissolved at pH: 3 | 5 | 7 |
|---|---|---|---|---|
| HEDP | 22.5 | 92 | 84 | 16 |
| Citric acid | 77.0 | 89 | 79 | 8 |
| NTA | 64.0 | ppt. | 73 | 50 |
| Blend 1 | 46.5 | 97 | 86 | 70 |
| Blend 2 | 32.6 | 87 | 88 | 60 |

The water source used is from St. Louis County, which is considered to be in a hard water area. Again, nitrogen gas is bubbled through each solution and the temperature is 77° C. The test is conducted for 4 hours. Each solution started with 1.40 grams/liter of $Fe_3O_4$, which has 1012 ppm Fe. The percent iron dissolved is determined first by using atomic absorption spectroscopy to find out how much free iron is left in solution, then determining the percentage iron oxide that is dissolved. The pH of the solutions is adjusted with potassium hydroxide, 45% liquid, when necessary.

Blend 1 consists of the following: 11.3 grams per liter HEDP, 19.2 grams per liter citric acid, and 16.0 grams per liter NTA.

Blend 2 consists of the following: 16.8 grams per liter HEDP, and 16.0 grams per liter NTA.

EXAMPLE 3

A second series of tests are conducted to demonstrate the ability of this chemical solution to dissolve iron and chloride stains on a hot rolled steel sheet. The chemical composition utilized had a pH of 8.5 and comprised of a mixture of 1-hydroxyethylidene-1,1-diphosphonic acid (HEDP), as the phosphonic acid and potassium hydroxide as the alkaline metal hydroxide, which is used to buffer this composition. The test is conducted in a standard fashion on a steel coupon, the steel coupon being a small piece of sheet steel used for testing.

A 1:1.16 ratio of HEDP/KOH, 45% liquid is tested with 1% w/w of active HEDP. Hot rolled steel coupons are pickled in a hydrochloric acid pickling bath for 3 minutes at 82° C. (180° F.) in order to remove the oxide layer on the surface of the coupon. The coupons are then rinsed in tap water (Mundelein, Ill.) and left to air dry for 3, 5, and 10 minutes respectively. During these time intervals, the iron and chloride stains are formed. After the stain had formed for the given time frame, the hot rolled steel coupons are immersed in the chemical solution for 35 seconds. The temperature of the chemical solution is 82° C. (180° F.) The results of the tests are as follows:

3 minute stain: Completely removed;

5 minute stain: Completely removed;

10 minute stain: Completely removed.

The definition of "Completely removed" is a term that can be understood as when the colored stain (greenish/gold for this particular lab experiment) that is formed on the hot rolled steel coupons during the 3, 5 and 10 minute intervals is removed or dissolved off of the surface of the coupons (sample pieces of sheet steel).

EXAMPLE 4

A third series of tests are conducted to demonstrate the stain removing capibility of the chemical solution used in Example 3 in a spray system. This test involved using the same chemical solution at different pH values. The procedure for forming the stain is identical to the procedure in Example 3, but the only time frame that is used for this test is the 10 minute interval. The 10 minute interval is considered to be the most severe case in terms of stain formation. The results of the spray testing is as follows:

| pH Values | Results |
|---|---|
| 6.1–6.2 | The stain is completely removed. |
| 7.1–7.2 | Approximately 80–90% of the stain remained on the surface of the coupon. |
| 8.2–8.3 | Approximately 90–95% of the stain remained on the surface of the coupon. |

These spray tests are conducted at 66° C. for 7–8 seconds at a spray pressure of 10–12 psi.

The results indicate that, by lowering the pH value of the HEDP/KOH mixture, it is possible to remove the stain that is produced during the 10 minute interval.

EXAMPLE: 5

This series of tests are conducted to demonstrate the iron oxide dissolving/removing capability of another process of this invention. The chemical compositions utilized are comprised of a mixture of 1-hydroxyethylidene-1, 1-diphosphonic acid (HEDP) as the phosphonic acid, and various alkaline materials which are used to neutralize the chemical composition.

Solutions containing 1% w/w of active HEDP are prepared and neutralized to a pH of about 8.5 using various alkaline materials. These solutions are heated to 85° Centigrade (185° F. ) for this test. Again, hot rolled steel coupons are processed in order to produce an objectionable stain (see Example 3). The 10 minute stain is used for this particular example because it is the most severe case. The results of the testing are as follows:

| Item | Grams per Liter |
|---|---|
| #1) Water, cold | 978.5 |
| HEDP, 60% Liquid | 10.0 |
| Potassium Hydroxide, 45% liquid | 11.5 |
| | 1,000.0 |
| pH = 8.2 | |
| 30 second immersion | |

Result: The stain is completely removed from the surface of the coupon. By "coupon" is meant a sample of sheet steel.

| Item | Grams per Liter |
|---|---|
| #2) Water, cold | 982.7 |
| HEDP, 60% Liquid | 10.0 |

-continued

| Item | Grams per Liter |
|---|---|
| Sodium Hydroxide, 50% liquid | 7.3 |
| | 1,000.0 |
| pH = 8.3 | |
| 30 second immersion | |

Result: The stain is completely removed from the surface of the coupon.

| Item | Grams per Liter |
|---|---|
| #3) Water, cold | 983.2 |
| HEDP, 60% Liquid | 10.0 |
| Ammonium Hydroxide, 26° Be | 6.8 |
| | 1,000.0 |
| pH = 8.1 | |
| 30 second immersion | |

Result: The stain is completely removed from the surface of the coupon.

| Item | Grams per Liter |
|---|---|
| #4) Water, cold | 965.0 |
| HEDP, 60% Liquid | 10.0 |
| Triethanolamine, 99% liquid | 25.0 |
| | 1,000.0 |
| pH = 8.4 | |
| 30 second immersion | |

Result: 90% of the stain is removed from the surface of the coupon.

| Item | Grams per Liter |
|---|---|
| #5) Water, cold | 979.5 |
| HEDP, 60% Liquid | 10.0 |
| Diethanolamine, Liquid | 10.5 |
| | 1,000.0 |
| pH = 8.3 | |
| 30 second immersion | |

Result: 90% of the stain is removed from the surface of the coupon.

| Item | Grams per Liter |
|---|---|
| #6) Water, cold | 984.0 |
| HEDP, 60% Liquid | 10.0 |
| Monoethanolamine, Liquid | 6.0 |
| | 1,000.0 |
| pH = 8.2 | |
| 30 second immersion | |

Result: 95% of the stain is removed from the surface of the coupon.

| Item | Grams per Liter |
|---|---|
| #7) Water, cold | 975.9 |
| HEDP, 60% Liquid | 10.0 |
| Lithium Hydroxide, monohydrate | 14.1 |
| | 1,000.0 |
| pH = 8.5 | |
| 30 second immersion | |

Result: The stain is completely removed from the surface of the coupon.

| Item | Grams per Liter |
|---|---|
| #8) Water, cold | 980.0 |
| HEDP, 60% Liquid | 10.0 |
| Sodium Carbonate, Natural | 10.0 |
| | 1,000.0 |
| pH = 8.5 | |
| 30 second immersion | |

Result: 80% of the stain is removed from the surface of the coupon.

| Item | Grams per Liter |
|---|---|
| #9) Water, cold | 971.5 |
| HEDP, 60% Liquid | 10.0 |
| Tetrapotassium Pyrophosphate | 18.5 |
| | 1,000.0 |
| pH = 8.1 | |
| 30 second immersion | |

Result: 70% of the stain is removed from the surface of the coupon.

| Item | Grams per Liter |
|---|---|
| #10) Water, cold | 981.0 |
| HEDP, 60% Liquid | 10.0 |
| N,N-Diethylethanolamine | 9.0 |
| | 1,000.0 |
| pH = 8.2 | |
| 30 second immersion | |

Result: 75% of the stain is removed from the surface of the coupon.

Materials that will also work well other than the alkali metal hydroxides, alkali metal carbonates and alkali metal phosphates and alkaline amines are alkaline metal silicates and borates, alkaline organic compounds and most any non-chloride, non-cyanide alkaline materials.

EXAMPLE: 6

This series of tests are conducted to demonstrate the iron oxide dissolving/removing capability of another chelant for this invention. The chemical compositions utilized comprised of a mixture of citric acid as the chelating agent and potassium hydroxide, 45% liquid, as the alkali metal hydroxide, which is used to buffer the compound.

Hot rolled steel coupons are pickled in a hydrochloric acid pickling bath for 3 minutes at 88° C. (190° F.) in order to remove the scale/oxide layer on the surface of the coupon. The coupons are then rinsed in tap water (Mundelein, Illinois) and left to air dry for 10 minutes. During this time, an objectionable stain is formed, which consists of iron oxides and residual chlorides. After 10 minutes, the hot rolled steel coupons are immersed in the chemical solution for approximately 30 seconds. The temperature of the solution is 85° C. (185° F.), and the pH values are varied to determine at which range this chemical composition can work best. The results are as follows:

| Item | Grams per Liter |
|---|---|
| #1) Water, cold | 976.0 |
| Citric Acid, Granular | 10.0 |
| Potassium Hydroxide, 45% | 14.0 |

-continued

| Item | Grams per Liter |
|---|---|
| | 1,000.0 |

Result: The stain is completely removed from the coupon in 15 seconds at a pH of 6.0–6.1.

| Item | Grams per Liter |
|---|---|
| #2) Water, cold | 974.0 |
| Citric Acid, granular | 10.0 |
| Potassium Hydroxide, 45% hate | 16.0 |
| | 1,000.0 |

Result: The stain is completely removed from the coupon in 30 seconds at a pH of 7.0–7.1.

| Item | Grams per Liter |
|---|---|
| #3) Water, cold | 971.5 |
| Citric acid, granular | 10.0 |
| Potassium Hydroxide, 45% | 18.5 |
| | 1,000.0 |

Result: The stain is completely removed from the coupon in 45 seconds at a pH of 8.5–8.6.

All three tests that are conducted use chemical solutions that contained 1% w/w of citric acid and enough potassium hydroxide, 45% liquid, to raise the pH to the desired value. The results show that the citric acid/-potassium hydroxide mixture will remove the stain in a reasonable amount of time. The results also show that this chemical mixture will remove the stain more quickly at lower pH values.

EXAMPLE: 7

This series of tests are conducted to demonstrate the iron oxide dissolving/removing capability of another method of this invention. The chemical compositions utilized comprised of a mixture of ethylenediaminetetraacetate, tetrasodium salt, tetrahydrate (EDTA-$Na_4$) as the chelating agent and various alkaline materials, which are used to neutralize the chemical composition.

Solutions containing 1% w/w of active EDTA-$Na_4$ are prepared and neutralized to a pH of about 8.5, using various alkaline materials. These solutions are heated to 85° C. (185° F.) for this particular example. Again, hot rolled steel coupons are processed in order to form the objectionable stain (as shown in Example 3). Again, the 10 minute stain is used for this particular test. The results of the testing are as follows:

| Item | Grams per Liter |
|---|---|
| #1) Water, cold | 977.0 |
| EDTA-$Na_4$ | 10.0 |
| Potassium Hydroxide, 45% liquid | 13.0 |
| | 1,000.0 |
| pH = 8.3 | |
| 30 second immersion | |

Result: The stain is completely removed from the surface of the coupon.

| Item | Grams per Liter |
|---|---|
| #2) Water, cold | 983.6 |
| EDTA-$Na_4$ | 10.0 |

-continued

| Item | Grams per Liter |
|---|---|
| Monoethanolamine, liquid | 6.4 |
| | 1,000.0 |
| pH = 8.2 | |
| 30 second immersion | |

Result: 95% of the stain is removed from the surface of the coupon.

| Item | Grams per Liter |
|---|---|
| #3) Water, cold | 977.8 |
| EDTA-$Na_4$ | 10.0 |
| Diethanolamine, liquid | 12.2 |
| | 1,000.0 |
| pH = 8.2 | |
| 30 second immersion | |

Result: 90% of the stain is removed from the surface of the coupon.

| Item | Grams per Liter |
|---|---|
| #4) Water, cold | 972.0 |
| EDTA-$Na_4$ | 10.0 |
| Triethanolamine 99% liquid | 28.0 |
| | 1,000.0 |
| pH = 8.3 | |
| 30 second immersion | |

Result: 90% of the stain is removed from the surface of the coupon.

| Item | Grams per Liter |
|---|---|
| #5) Water, cold | 978.0 |
| EDTA-$Na_4$ | 10.0 |
| Sodium Hydroxide, 50% liquid | 12.0 |
| | 1,000.0 |
| pH = 8.5 | |
| 30 second immersion | |

Result: The stain is completely removed from the surface of the coupon.

The results show that solutions containing 1% active EDTA-$Na_4$ will remove the stain in a reasonable amount of time. Other materials that can be used to neutralize the EDTA-$Na_4$ are alkaline metal carbonates, alkali metal phosphates, alkaline metal silicates, borates, and most any non-chloride or non-cyanide containing alkaline material.

EXAMPLE 8

A series of tests are conducted to determine the effect of temperature on stain removal. Hot rolled steel panels are immersed in a 30% v/v solution of 20° Be hydrochloric acid to remove scale formed in the hot rolling process. The panels are subsequently immersion rinsed with clean tap water (Mundelein, Ill.) for 5 seconds and set horizontally for 3,5, and 10 minutes to produce the iron oxide and chloride residual based stain.

The stain removing solutions are made up with 10 grams per liter of 1-hydroxyethylidene-1,1-diphosphonic acid and are adjusted to a pH of about 8.5 using potassium hydroxide, 45% liquid. The solutions are adjusted to various temperatures before immersing the stained panels to evaluate the stain removal. The results are an average of three tests per stain. The results are as follows:

| Stain Removing Temperature/ | Removal Time (Seconds) 3 minute stain/ | 5 minute stain/ | 10 minute stain |
|---|---|---|---|
| 55° C. | 75 | 108 | 141 |
| 60° C. | 62 | 87 | 110 |
| 65° C. | 49 | 66 | 84 |
| 70° C. | 49 | 49 | 63 |
| 75° C. | 33 | 38 | 46 |
| 80° C. | 26 | 32 | 35 |
| 85° C. | 22 | 29 | 32 |
| 90° C. | 20 | 28 | 30 |
| 95° C. | 19 | 26 | 29 |
| 100° C. | 19 | 25 | 29 |

The results show that at elevated temperatures it is easier to remove the stain, or that the stain will be removed more quickly.

EXAMPLE 9

A series of tests are carried out to compare the stain dissolving/removing capabilities of various chelating agents at a pH value of 8.5.Hot rolled steel coupons are immersed in a 30% v/v solution of 20° Be hydrochloric acid at 83° C. (180° F.)for 3 minutes, to remove the scale that is formed during the hot rolling process. The coupons are subsequently rinsed in clean tap water (Mundelein, Ill.) in a beaker for approximately 5 seconds and allowed to set horizontally for 5 minutes so that the iron oxide based stain will form.

Various chelating solutions are used to determine their stain dissolving/removing capabilities. All of the stain removing solutions are comprised of 10 grams per liter chelant adjusted to a pH of about 8.5 using potassium hydroxide and heated to 83° C.

| Chelant System | Stain Removing Time |
|---|---|
| HEDP | 27 seconds |
| EDTA—$Na_4$ | 42 seconds |
| Citric Acid | 62 seconds |
| Nitrilotriacetic Acid (NTA) | 34 seconds |
| HEDP/Citric Acid (1:1 ratio) | 33 seconds |
| HEDP/EDTA—$Na_4$ (1:1 ratio) | 28 seconds |
| HEDP/NTA (1:1 ratio) | 25 seconds |
| EDTA—$Na_4$/NTA (1:1 ratio) | 36 seconds |
| EDTA—$Na_4$/Citric Acid (1:1 ratio) | 47 seconds |
| Citric Acid/NTA (1:1 ratio) | 51 seconds |
| HEDP/NTA/Citric Acid (1:1:1 ratio) | 24 seconds |

The results indicate that mixtures of various chelants will remove or dissolve the stain in a reasonable amount of time. The results also show that mixtures of these chelants will also remove the stain quicker than if each chelant are 15 used separately.

EXAMPLE 10

Chloride ions will also contribute to the formation of the stain. The chloride ions are present due to the hydrochloric acid pickle carry over. Rinsing is of major importance in order to remove these residual chloride ions. The following table describes the importance of rinsing on different types of sheet steel:

| | Chlorides on surface, mg/ft$^2$, after Contamination | | |
|---|---|---|---|
| Steel Type | In NaCl Solution | 1st Rinse | 2nd Rinse |
| Mild Steel | 89 | 6.0 | 5.0 |

-continued

| Steel Type | Chlorides on surface, mg/ft$^2$, after Contamination | | |
|---|---|---|---|
| | In NaCl Solution | 1st Rinse | 2nd Rinse |
| Polished Steel | 140 | 2.4 | 1.2 |
| Austentic steel | 54 | 0.5 | Less than 0.2 |

The samples are all rinsed by still immersion in distilled water in bench scale tests. Samples had been contaminated by a 15 minute immersion in a one (1%) percent weight/weight (w/w; solute to solvent) solution of sodium chloride. The results show that rinsing is very important for removing the residual chloride ions from the surface of the sheet steel.

Better rinsing is critical for removing the chloride ions from the surface of sheet steel. Mechanical adjustments can be made to a typical high-speed coil line to further improve rinsing. The following table shows the effectiveness of removing chloride residue from sheet steel by modifying the water rinse spraying systems:

Effect of modification of spray rinse on chloride residue on sheet steel.*

| Change made in Spray rinse | Chloride on sheet, mg/ft$^2$ | | |
|---|---|---|---|
| | Samples tested | Average | Range |
| None | 15 | 0.34 | 0.22 to 0.78 |
| Different spray pattern (1) | 10 | 0.29 | 0.15 to 0.46 |
| Add squeege rolls (2) | 13 | 0.19 | 0.08 to 0.44 |
| Lower spray press. (3) | 16 | 0.12 | 0.05 to 0.21 |

Changes in the spray pattern combined with lowering the spray pressure to provide flood rinsing contributes to better removal of chloride ion residues.

(1) Different spray pattern includes changing the spray angle of the nozzles. Changing the nozzles from v-jets to flood nozzles to help flood the sheet with water rather than a more direct impingement approach.

(2) A recent study of changes in the spray rinse stages of a continuous pickle line by a eastern producer, showed that the addition of another set of squeegee rolls between the two spray-rinse stages provided a great improvement in rinsing effectiveness.

(3) Lowering the spray pressure from approximately 14.3 kilograms per square centimeter (80 pounds per square inch) to approximately 4.5 kilograms per square centimeter (25 pounds per square inch).

This example is partially based on an article "Pickle Line Rinsing Practice", by L. E. Helwig, consultant, Glenshaw, Pa., which appeared in *Iron Age*, Apr., 1988.

Modifications to the rinse sections on high speed coil lines will help to improve or reduce the contamination of the surface of the steel sheet. However, none of these modifications are completely effective and some residual chloride will still remain on the steel surface.

The key factor is clearly the buffered chelating agent of this invention. This method of treatment with this composition improves the appearance of the sheet steel and avoids the problems inherent in sheet steel having stains thereon.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the U.S. is:

1. A method of removing a stain from sheet steel during a sheet steel pickling process comprising:

a) selecting at least one chelating agent from the group consisting if ethylenediaminetetraacetic acid, 1-hydroxyethylidene-1,1-diphosphonic acid, aminotrimethylenephosphonic acid, and nitrilotriacetic acid at a concentration in a range of 1 gram to 100 grams per liter;

b) selecting at least one buffering agent from the group consisting of potassium hydroxide, sodium hydroxide, ammonium hydroxide, triethanolamine, monoethanolamine, and diethanolamine;

c) providing a mixture of at least one of said chelating agents and at least one of said buffering agents; and d) applying the mixture to the steel sheet at a temperature of 65° C. to 110° C. for 5 seconds to 2 minutes and at a pH of 4.0 to 10.5 to thereby remove the stain from the steel sheet and improve the appearance of the steel sheet.

2. The method of claim 1 wherein the mixture is applied to the sheet steel by spraying.

3. The method of claim 1 wherein the mixture is applied to the sheet steel by immersion.

4. The method of claim 1 wherein the mixture is applied by a combination of spraying and immersion.

5. The method of claim 1 wherein the applying occurs at a pH from about 6 to about 9, a temperature of about 75° C. to about 105° C. and a time of about 10 seconds to about 100 seconds.

6. The method of claim 5 wherein the applying occurs at a pH from about 6.5 to about 8, a temperature of about 80° C. to about 95° C. and a time of about 25 seconds to about 45 seconds.

7. The method of claim 1 wherein the immersion time of the sheet steel is 25 to 70 seconds.

8. The method of claim 1 wherein the spray time of the sheet steel is 10 to 30 seconds.

9. The method of claim 1 wherein the mixture of a chelating agent and a buffering agent includes 1-hydroxyethylidene-1,1-diphosphonic acid and potassium hydroxide.

10. The method of claim 1 wherein:

a) the mixture of the chelating agent and a buffering agent is applied by spraying, immersion or combinations thereof;

b) the chelating agent is 1-hydroxyethylidene-1,1-diphosphonic acid; and c) the buffering agent is potassium hydroxide.

11. The method of claim 1 wherein the concentration of the chelating agent is from about 1 gram to about 100 grams per liter.

* * * * *